United States Patent [19]

Capdebosco

[11] Patent Number: 5,003,854

[45] Date of Patent: Apr. 2, 1991

[54] DEVICE FOR FASTENING A DIE ON A TOOL CARRIER CYLINDER OF A ROTARY MACHINE

[75] Inventor: Bernard Capdebosco, Saint-Just-Chaleyssin, France

[73] Assignee: Siemens Aktiengesellschaft, Berlin and Munich, Fed. Rep. of Germany

[21] Appl. No.: 483,621

[22] Filed: Feb. 23, 1990

[30] Foreign Application Priority Data

Feb. 24, 1988 [FR] France ..... 89 02729

[51] Int. Cl.[5] ..... B26D 7/26

[52] U.S. Cl. ..... 83/331; 83/665; 83/698; 29/129; 29/130; 403/358; 403/374; 393/471

[58] Field of Search ..... 83/698, 343, 345, 665, 83/666, 346, 347, 331; 29/129, 130, 117; 493/370, 471; 403/358, 374; 101/415.1

[56] References Cited

U.S. PATENT DOCUMENTS 3,274,873 9/1966 Sauer ..... 83/347
3,400,648 10/1968 Izmailov et al. ..... 29/117 X
3,822,953 7/1974 Adelizzi ..... 403/358 X
3,991,964 11/1976 Christopher ..... 403/374 X
4,208,147 6/1980 Giege et al. ..... 29/117

*Primary Examiner*—Douglas D. Watts
*Assistant Examiner*—Kenneth E. Peterson
*Attorney, Agent, or Firm*—Hill, Van Santen, Steadman & Simpson

[57] ABSTRACT

A device for fastening a die, such as a semi-cylindrical element on a tool carrying cylinder, which includes each of the dies having parallel extending ribs provided either with oblique surface portions or an oblique surface, the carrier is provided with circular grooves corresponding to the ribs and longitudinally extending grooves crossing the circular grooves which support locking rods. The device also includes an arrangement for shifting the locking rods from a released position to a locking position. In one embodiment, each of the locking rods has a notch for receiving the ribs and is provided with an oblique surface for engaging the oblique surface portion of the rib to lock the rib in the circular groove as the rods assume a locking position. In a second embodiment, each of the circular grooves has an oblique side wall and each of the rods urges the rib against the oblique side wall to cause a locking of the rib in the groove.

11 Claims, 4 Drawing Sheets

DEVICE FOR FASTENING A DIE ON A TOOL CARRIER CYLINDER OF A ROTARY MACHINE

BACKGROUND OF THE INVENTION

The present invention is directed to a device for fastening a die on a cylindrical tool carrier of a rotary machine, which may be a box board converting machine.

In order to reduce, as much as possible, the lack of positioning precisions of a processing tool and also to render changes of such tool easier when passing from one production run to another, professionals customarily fit these tools previously on a die which is thereupon transferred onto a cylindrical tool carrier which might be the upper cylinder. A lower cylinder would then be provided with an elastomer tape or coating. With the cylinders rotating at a high speed and in full synchronization, the pair of cylinders will carry a processible workpiece forward and process the workpiece simultaneously.

Such a die appears in the form of a cylindrical portion or shell, for example a wooden one, cut into pieces according to a precise pattern, and the configuration of the tools have to be fitted on these dies. The term "inner front face of the die" means the underlying face turned toward the axis of rotation of the cylindrical tool carrier. Such a processing tool can then be inserted into apertures of the die until their base reaches the level of the inner aperture configuration and the upper and active tool parts protrude, then, from an outer front face of the die.

With the present state of the art, a tool carrier cylinder has a screen-like network of tapped apertures allowing the fastening of the die onto the cylinder by threaded fasteners, such as screws. Considering the high speed of rotation for the cylinder, as well as the non-negligible weight of the dies provided with the processing tools, the centrifugal forces arising at the level of the die are considerable and have a tendency to tear the die from the cylinder. In consideration of this technique, such a die will, therefore, have to be screwed on at numerous points. Thus, during a die change, this will necessitate a long machine down time. Moreover, as every screw has to be tightened individually, it cannot be excluded that one or several of these screws might be accidentally omitted and, thus, the process of changing dies includes a lengthy and fastidious checking at the end of the job to avoid any accidents due to improper securing of the die on the cylinder.

SUMMARY OF THE INVENTION

The purpose of the present invention is to create a fastening device for a processing die on a cylindrical tool carrier which enables a quick and easy fitting and provides a die with a firm and permanent hold. Such a device should, furthermore, insure maximum supporting surfaces between the die and the cylinder of the tool carrier.

In order to accomplish these goals, the present invention is directed to a fastening device wherein a die is provided on its inner face with an adequate number of parallel extending bows or ribs, all of which have, on one face situated on the same side of the bow or rib, oblique surface parts oriented outward. The tool carrier cylinder has, on its outer face, a first row of circular crosswise grooves extending crosswise in which each of the bows can be seated. Moreover, each of the tool carriers has a second row of lengthwise extending grooves which are deeper than the first-mentioned group and house a locking rod which is held radially but can be shifted in a longitudinal direction or in an axial direction of the cylinder. At a level of every circular groove, the locking rod has a crosswise slot which is at least of a size to receive the bow. This rod can be caused to slide to and fro by mechanical and/or pneumatic or electrical means in such a way that all walls situated on the same side as the crosswise slot engage in the bows in order to lock them within their corresponding circular grooves. Preferably, the dies consist of two half-cylindrical shells and the locking rods, as well as their respective grooves, have a transverse cross sectional shape of an inverted T.

According to a first appropriate approach, the crosswise circular grooves have a rectangular cross section and all walls on the same side as the crosswise slots on the locking rods opposite which are positioned oblique parts of the bows when seated within the circular grooves are provided with equally shaped oblique surfaces that are oriented inwardly.

According to another appropriate approach, the crosswise slots of the locking rods have a shape of a parallelepiped. Thus, all faces on the same side of the bows are obliquely oriented outwardly and all walls of the same side of the circular crosswise grooves situated opposite the oblique faces of the bows are equally provided with an oblique or undercut face that is oriented inwardly.

According to a first modification, the mechanical means for causing all locking rods to slide within the lengthwise grooves consist of a spindle held fixed lengthwise and movable in an end wall of the cylinder at the end of the lengthwise grooves. The head of this spindle appears to be outside of the cylinder, whereas the lower part is engaged in a threaded bore arranged to extend lengthwise in the corresponding end of a locking rod.

According to a second modification, the means for causing the locking rods to slide within their lengthwise grooves comprises each of the rods being provided with return or biasing means at one end for urging each of the rods in the direction towards the oblique sides of the bows or ribs. Each return or biasing means acting between an end of each of the locking rods and an end wall of the cylinder, each of the rods, on an end opposite the biasing means, having an extension slidably received in an axially extending hole of an end of the cylinder wall; a jack fitted on an outer fixed part situated close to the other end of the cylinder and actuating a half-circular pushing plate which, as soon as the cylinder has taken up a predetermined position, will simultaneously press all of the extensions of the locking rods arranged for one of the semi-circular shells in order to shift the locking rods to a release position to release the shell.

According to a third modification, the means causing the locking rods to slide within their lengthwise grooves comprise the biasing means at each end of the lengthwise groove for biasing each of the rods into a position with the oblique surfaces engaging the oblique portions of the bows, each of the locking rods, at an end opposite the biasing means, having an extension engaging a shiftable semi-circular pushing rim, a semi-annular jack situated in the cylinder wall for pushing the semi-circular pushing rim in a direction to move each of the locking rods against the biasing means to an unlocking position. Each of the jacks can be a pneumatic jack.

Other advantages and features of the invention will be readily apparent from the following description of the preferred embodiments, the drawings and claims.

DESCRIPTION OF THE PREFERRED EMBODIMENTS

Figure 1:
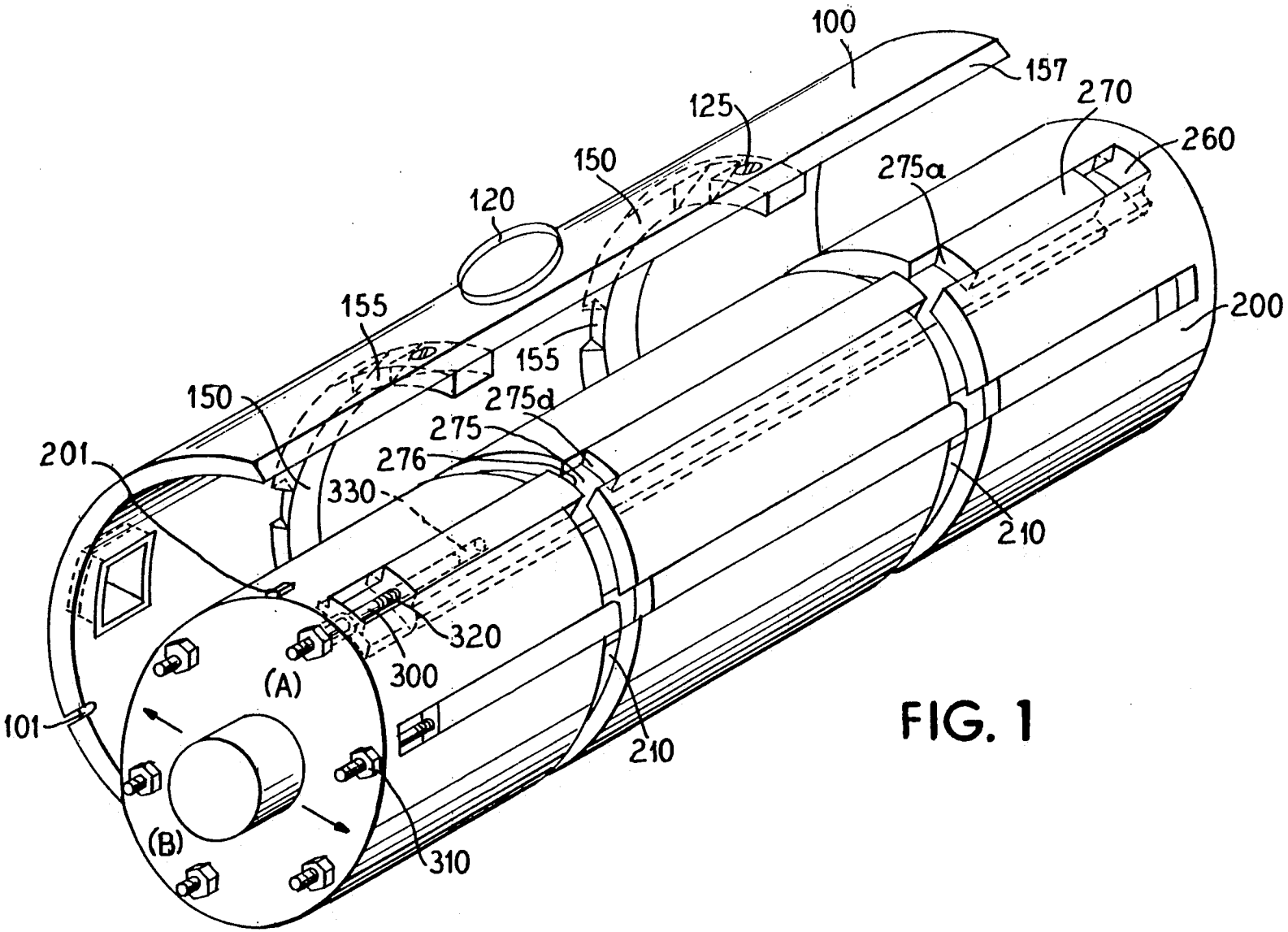
FIG. 1 is a perspective view of a first form of the fastening device in accordance with the present invention for locking a die on a tool cylinder.

The principles of the present invention are particularly useful when incorporated in a locking device for holding a die 100 on a tool carrier cylinder 200. The die 100 appears, on a general basis, as a portion of a wooden cylinder on which the cutting tool, such as 120, are fitted. The die 100 has a bend radius which is essentially equal to the outer radius of the tool carrier cylinder 200 on which it is supposed to be fitted. As a result of this invention, it appears to be more appropriate to use only two identical dies, each covering a half of the cylinder. These particular dies, which have cylindrical shape will be designated as a shell 100.

The die or shell 100 is, moreover, provided on its inner face, which is directed towards its axis of rotation with a number of metal bows or ribs 150 which have a rectangular cross section. Every one of the bows belongs to a plane situated to extend at right angles with regard to the axis of rotation. Every bow 150 is permanently secured on the die 100 by means of screws, such as 125, though every other permanent connecting device, such as, for example, bolts or cotter pins, will also be usable.

According to the present invention, all of the lateral faces or surfaces on the same side of each of the ribs, as shown On the left-hand side in FIG. 1, have oblique parts or portions 155 which are oriented outwardly. In other words, the bows or ribs 150 have a rectangular cross section whereas the part 155 has a trapezoidal cross section and the inner face or base of which is broader than the outer face which, itself, is in contact with the die 100 and of which one of the lateral faces is generally perpendicular to the die 100. The other face is, thus, oblique and forms an angle containing between 30° and 60° with an inner face of every die 100.

A tool carrier 200 is provided with an adequate number of circular crosswise grooves 210 which, as in the case illustrated, has a crosswise section equally rectangular. Each of the grooves 210 has a width and depth which is at least equal to the width and height of the corresponding bow 150 which will take their seat when the die is fitted on the carrier.

The cylinder 200 has an adequate number of lengthwise or longitudinally extending grooves 260 machined at regular intervals along the cylinder's circumference. These lengthwise grooves 260 are deeper than the circular grooves 210 so that each of them may take up a locking rod 270, which is slidable in the groove in the longitudinal direction but is held against radial movement. To this aim, as shown in FIG. 1, the rods 270, as well as the lengthwise grooves 260, have a transverse cross sectional shape of an inverted T. This inverted T shape of the grooves can be made either by a direct cutting with a special tool or else by cutting a first rectangular groove, which is broader, and then by screwing or welding on two additional lips on either side of the upper edges to form the T-shaped cross section.

At the crossing point of every groove 210, every locking rod 270 has a slot 275 with a depth equal to the grooves 210. The dies or shells 100, which are destined to be fitted on the cylinder 200 in such a way as every oblique part 155 will take up a seat within the slot 275. Each slot 275 has a wall 276 which will be opposite the oblique part 155 of the bow or rib 150 and will, itself, be oblique though oriented downward. This wall 276 will form with the horizontal bottom of the slot 275 an angle in a range between 30° and 60°, preferably an angle identical to the one existing between the oblique part 155 of the bow 150 and the inner face of the die 100. In other words, the crosswise slot 275 has a trapezoidal cross section, the inner face of which is broader than the outer face, which latter is at least as broad as the groove 210, i.e., as with the inner face of the bow 150. For an easy positioning of the die or the shell 100 on the cylinder 200, the lateral edges of the die have been provided with a slot 101 which is to take-up or receive a catch or projection 201 provided on the lateral edge of the cylinder 200. Obviously, the catch may be provided on the die and the slot formed in the cylinder's edge. Regardless of which arrangement, when the slot 101 is received on the projection 201, the shell 100 will be in a fixed position relative to the cylindrical surface of the carrier 200.

The length of the locking rods 270 is such as to be able to slide within the lengthwise grooves 260. As a matter of fact, the position of this locking rod 270 within the groove 260 is provided by a mechanical means which consists, in the embodiment of FIG. 1, of a control spindle 300. The control spindle 300 is held fixed in a lengthwise direction at the end of the cylinder 200, but can be rotated. The spindle 300 has a threaded portion 320 which is engaged in a tapped or threaded bore 330 in the corresponding end of the locking rod 270. The spindle has a head which extends past the outer end of the cylinder 200 and is, thus, accessible for an operator.

As described above, the fastening device, according to the invention, is used in the following way:

Every spindle head 310 is previously turned in such a direction, for example, normally counterclockwise, that the corresponding locking rod 270 will be shifted toward the left-hand lateral face of the cylinder. This rotation is carried out until the end of the locking rod 270 engages against the end of the lengthwise groove 260 which is close to the spindle head 310. In this retracted position, the oblique side 276 of every slot 275 is entirely out of the corresponding crosswise circular groove 210, whereas the opposite wall **275*a*** of the slot is flushed with the right-hand edge of the groove.

With the grooves 210 fully disengaged, it will be easy to insert the bows 150 and to completely adjust the die 100 on the cylinder 200. However, the operator is to make sure not to reverse the left and right-hand sides of this die or shell 100, i.e., with respect to the orientation of the oblique parts 155 of the bow opposite the wall 276 of every slot. Moreover, he is to adjust the angular position of the die 100 by appropriate sliding along the groove 210 in such a way that the oblique parts 155 are lodged in the slots 275, which is in the case when the notch 101 is engaged with the catch 201. In order to prevent any erroneous orientation, the outer faces of the die 100 and of the cylinder 200 may also be provided with arrows on the end, as illustrated.

The operator is then able to turn the screw heads 310 in the reversed or clockwise direction, which action will shift the corresponding locking rods 270 to the right-hand side, as shown in FIG. 1. With the rod movement taking place, all oblique faces 276 will simultaneously engage the oblique parts 155 of the corresponding bow which will gradually be forced to move inwardly to adjust the die 100 optimally on the cylinder 200. Customary means, such as ratchets, can be fixed on the heads 310 in order to prevent an involuntary counterclockwise rotation in the course of the processing operations.

Figure 2:
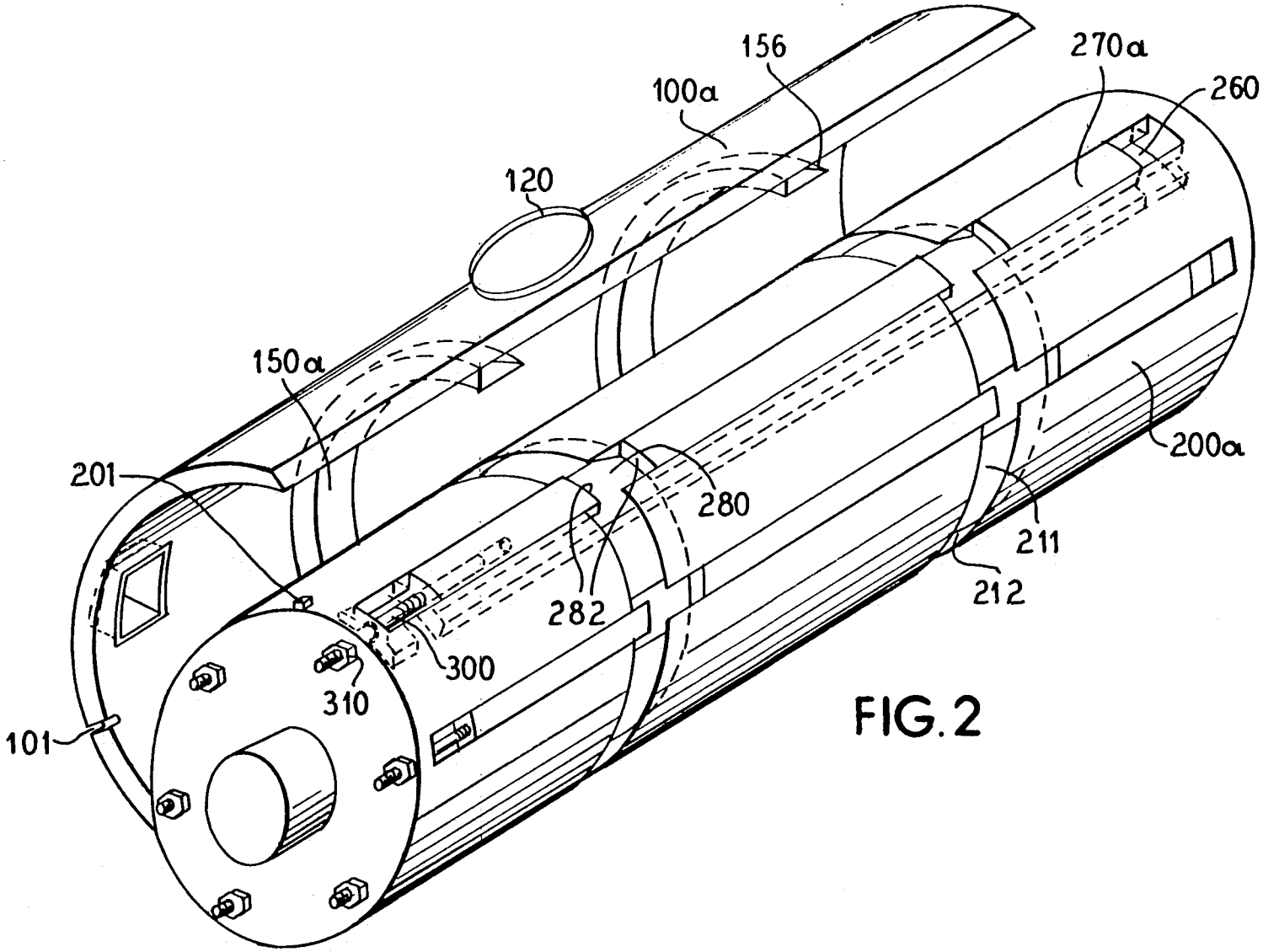
FIG. 2 is a perspective view of a second embodiment of a fastening device in accordance with the present invention for locking a die onto a tool carrying cylinder.

A second embodiment of the fastening device is illustrated in FIG. 2. In this embodiment, a die or shell 100*a* is fully identical with the shell 100 of the embodiment of FIG. 1. It should be noted, however, that in this embodiment, each of the bows or ribs 150*a* have a face or surface 156 which is an oblique surface. As illustrated, the tool carrier cylinder 200*a* contains an adequate number of crosswise circular grooves 211 and an adequate number of lengthwise grooves 260, within which locking rods 270*a* are to slide under the action of the control spindles 300. On the one hand, a wall 212 of each of the grooves 211, which is situated to be opposite the oblique surface 156 of each bow 150*a*, will be oblique and oriented downward, as illustrated.

In this configuration, the width of the grooves 211 measured at the level of the surface of the cylinder 200*a* should be at least equal to the largest and innermost surface of the bow 150*a*. The slots 280, which cut into the locking rod 270*a* at the crossing points of every groove 211, are to have a rectangular shape. Thus, as illustrated, the vertical walls on the left and right-hand sides extend substantially parallel to a plane extending at right angles to the axis of the cylinder 200*a*.

When putting the die or shell 100*a* on the cylinder 200*a*, the operator is to begin as previously mentioned by pulling all of the locking rods 270*a* toward the left-hand side and the retracted position by turning the corresponding screw heads 310 counterclockwise. As soon as the locking rods 270*a* are stopped by the left-hand end of the groove 260, all left-hand walls 282 will be flushed with the corresponding edges of the groove 211. This arrangement will then allow an engagement of the bows 150*a* in the corresponding grooves 211 to put the die or shell 100*a* onto the cylinder 200*a* and to slide the die 100*a* around in order to engage the slot 101 in the catch 201. To this aim, all locking rods 270*a* are to be shifted slowly, one-by-one toward the right-hand side by appropriate turning of the respective screw heads 310 in a clockwise direction. This will result in engaging all edges 282 of the slots 280 on their corresponding bows 150*a* and then, in shifting said bows or ribs and, hence, also the shell or die 100*a* to the right-hand side so that the oblique surface 156 of the bow 150*a* will engage the oblique walls 212 of their corresponding grooves 211. With the engagement of the faces 156 on the wall 212, the die or shell 150 will, thus, be secured onto the cylinder 200.

If the cutting of a groove 211 with an oblique wall proves to be more difficult and entails a higher final cost of the cylinder, and if the fitting of the die or shell 100*a* on the cylinder 200*a* implies, actually a sidewise translational movement likewise to impair the precision of the tool position, this variant has the advantage to provide an efficient control of the die or shell on the cylinder throughout the length of the bows.

In this connection, it should be mentioned that the device according to FIGS. 1 and 2 can also be combined. In this way, the face opposite the one containing the oblique part 155 of the bow 150, i.e., the right-hand face of FIG. 1, can equally be obliquely oriented toward the outside at a smaller angle possible contained between 70° and 80°. The initial vertical right-hand wall of every groove 200 is then oblique and oriented toward the inside of an identical angle containing between 70° and 80°. On account of this angle rate, the sidewise shift of the die 100 on the cylinder remains small, although the engagement of its side and the corresponding wall of the groove 210 is nonetheless sufficient for absorbing at least part of the securing effort.

Figure 3:
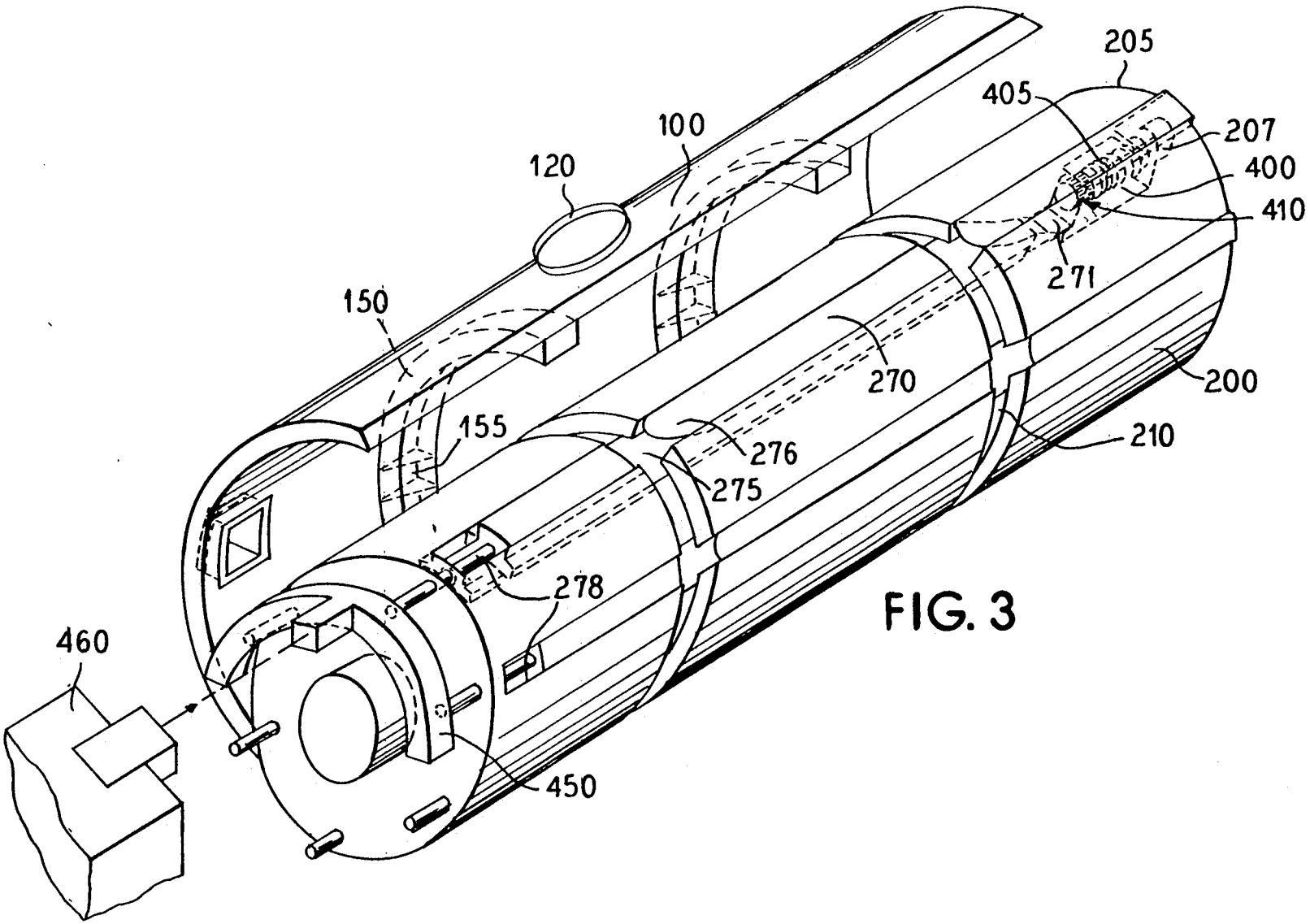
FIG. 3 is a perspective view showing a modification in the arrangement for shifting the locking rods of the locking device in accordance with the present invention.
Figure 4:
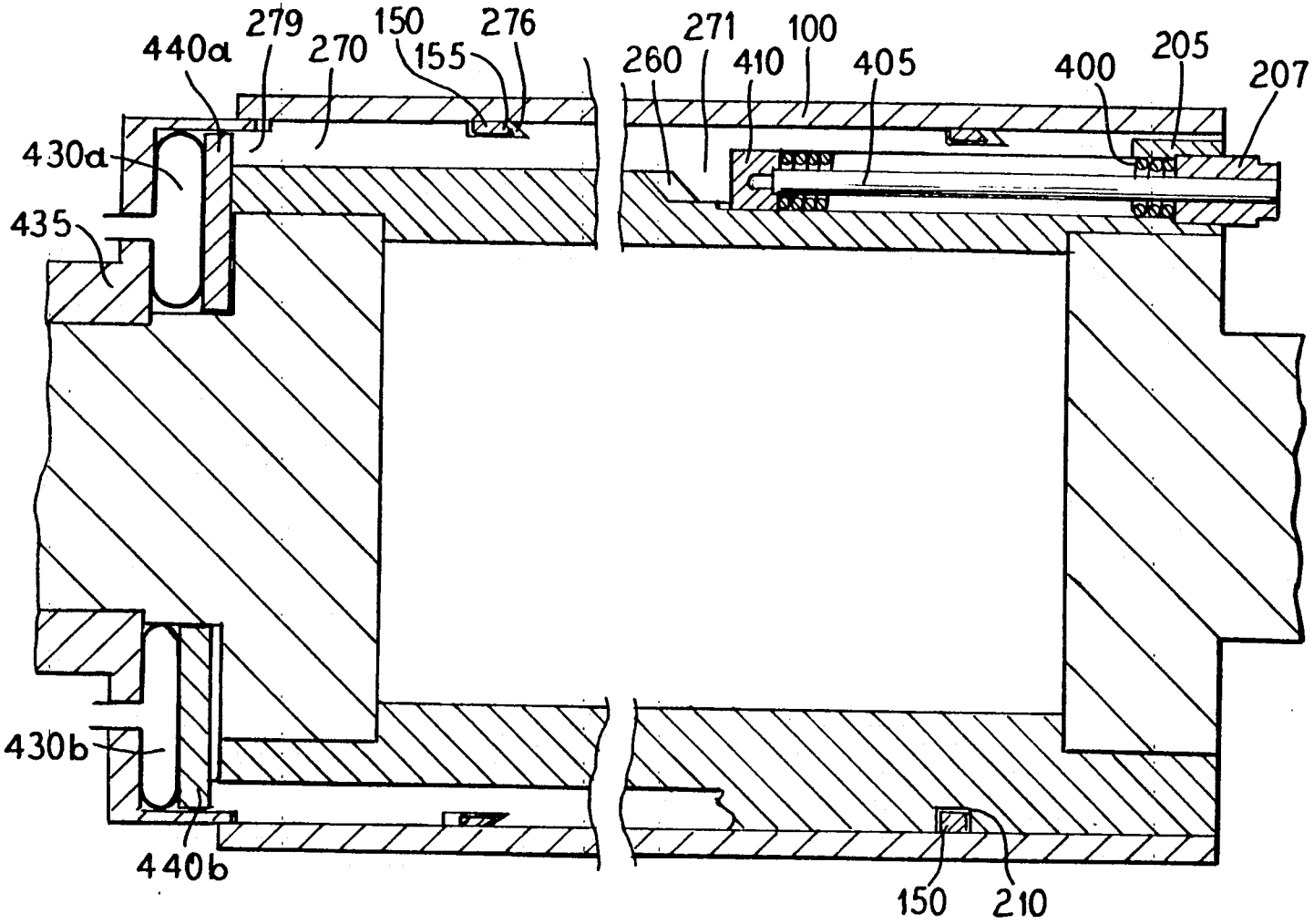
FIG. 4 is a cross sectional view with portions in elevation for purposes of illustration of another arrangement for actuating the locking rods of the holding device of the present invention.

Considering the use of two half-shells 100 only on each cylinder 200, it appears useful to envision a mechanical and pneumatic device allowing a simultaneous actuation of all of the locking rods 270 of the cylinder half independent from the locking rods 270 belonging to the other half. Two ways of realizing this arrangement relative to the fastening described with reference purposes by FIG. 1 are represented by FIGS. 3 and 4, respectively. These means described hereafter can obviously be adapted with only a little modification onto the arrangement illustrated by the embodiment of FIG. 2.

Each of the locking rods 270 is provided with a common spring 400 which acts between a nut 207 threaded into a right-hand lateral end face 205 of the tool carrier cylinder 200 and an end stop 410 supported by a lower tongue 271 of the locking rod 270. The nut 207 is used only for an easy fitting and changing of the spring 400, if necessary, and it represents actually an extension of the right-hand lateral or end wall 205 of the cylinder. The spring 400 is held lengthwise by an inner rod 405. As shown by FIGS. 3 and 4, the oblique parts 155 of the bows 150 are actually oriented toward the right-hand side of the cylinder 200, the spring 400 has a tendency to hold the rod 270 and the oblique face 276 engaged on the bows 150.

As illustrated in FIG. 3, the mechanical and pneumatic means comprises, moreover, a jack 460 which is mounted on a fixed part of the station close to the cylinder 200. This jack is to actuate the supporting plate 450 which has the shape of a half-rim that is positioned parallel to the lateral face of the cylinder and situated close to an upper edge of this end face. Furthermore, every locking rod 270 is provided with an extension or tongue 271 having the shape of a rod which, as shown in FIG. 3, extends through the end face of the cylinder wall and is freely sliding therein.

If the plate 450 is put into a "retracted" position by the jack 460, all the springs 400 can shift the locking rods to the right and thereby shift the shell 100 on the cylinder. The ends of the extensions 278 will then protrude from the end face of the carrier.

For taking a shell 100 out, the machine is to be stopped, whereupon it will be possible to rotate the cylinder 200 manually or by means of a slow running motor until all of the extensions 278 of the locking rods 270 corresponding to the required shell will stand opposite the supporting plate 450. The jack 460 will then be actuated and, with the help of the supporting plate 450, will push all of the required locking rods 270 to the right-hand side against the springs 400 and disengage the shell 100.

In FIG. 4, mechanical and pneumatic means, including two semi-annular jacks 430*a* and 430*b* housed within a frame 435 fitted permanently on the left-hand side of the cylinder 200 will be operated. Every jack acts between the wall of the frame 435 and a half-rim 440*a* and 440*b*, respectively. Every half-rim simultaneously presses on all of the tongues 279 extending at the left-hand end of the locking rods of one or the other of the two shells.

As may be gathered from the upper half of FIG. 4, which shows the device of the jack 430*a* under pressure, the half-rim 440*a* is pressed against the left-hand lateral faces of the cylinder 200 by the jack 430*a* to, thus, push each of the tongues 279 and, hence, the locking rods 270 toward the right and a retracted position. This sliding action of the locking rods is against the action of the respective springs 400 which are compressed between the part 271 with the end stop 410 and the nut 207. This sliding action ultimately results in disengagement of the bows or ribs 150 of the die or shell 100.

With the jack 430*b* out of pressure, as shown by the lower left-hand half of FIG. 4, the locking rods 270 are pushed back by their respective, though not represented, springs 400 which will shift the rim 440*b* toward the left-hand side, thereby crushing and emptying partially the jack 430*b*. The sliding action of the locking rods also causes the bows 150 to be hooked and engaged by the oblique surfaces 276. Thus, by a simple controlling of the valve regulating the compressed air flow of either the jacks 430*a* or 430*b*, the operator is able to simultaneously engage or disengage all of the ribs corresponding to one or the other of the shells 100.

Numerous improvements can be added to this fastening within the framework of the present invention. So, without setting any limits, the die or shell 100 can be made of metal. In such a case, the bow 150 can also be an integral part of the die or shell or be added by welding. Moreover, the oblique faces of the bow 150 or the wall 276 contained within the slot 275 o the lateral wall 212 contained within the groove 211 can, for instance, have a nonlinear, but a concave or convex shape, depending on the respective technical advantages.

Although various minor modifications may be suggested by those versed in the art, it should be understood that I wish to embody within the scope of the patent granted hereon all such modifications as reasonably and properly come within the scope of my contribution to the art.

I claim:

1. A device for fastening a die on a tool carrier cylinder of a rotary machine, said device comprising the die being provided on an inner surface with an adequate number of parallel extending ribs with each rib having a pair of side walls and an inner face and a base extending therebetween, said inner face spaced from being the inner surface of the die, one side wall of each of said ribs facing in the same direction and having an oblique surface portion being oriented outwardly with the inner face of the rib being broader than the base of the rib at each oblique surface portion, said tool carrier cylinder being provided on an outer surface with a first row of circular cross grooves constructed for receiving said ribs of the die, said cylinder having a second row of longitudinal grooves deeper than the first row of grooves, a locking rod being disposed in each of the longitudinal grooves, said longitudinal grooves having means to prevent radial movement of the rods and enabling movement along the length of said longitudinal grooves, each of said locking rods at a level of the circular cross grooves having a cross slot of a size equal to the cross sectional size of each of the ribs, and means for moving said rods to cause second oblique surfaces disposed in the circular cross grooves and cross slots to engage the oblique surface portions of each of the ribs to hold the ribs in said circular cross grooves and to hold the die on said carrier cylinder.

2. A device according to claim 1, wherein the die consists of two half cylindrical shells.

3. A device according to claim 1, wherein each of the locking rods and the respective longitudinal grooves have a cross sectional shape of an inverted T.

4. A device according to claim 1, wherein each of the circular cross grooves of the carrier cylinder has a rectangular cross section and each of the second oblique surfaces is a wall of each of the cross slots of the locking rods.

5. A device according to claim 1, wherein each of the crosswise slots of the locking rods is a parallelepiped and the second oblique surfaces coacting with the oblique surface portions of the ribs are oblique surfaces formed along a wall of each of the circular cross grooves and each of the ribs has a single oblique surface portion extending along the entire length of the one side wall.

6. A device according to claim 1, wherein the means for moving the rods comprises a spindle for each rod being fixed lengthwise in an end of the cylinder, each spindle having a threaded portion engaged in a threaded bore of said rod so that rotation of said spindle in one direction shifts the rod in one direction in the longitudinal groove while rotation of said spindle in the opposite direction shifts the rod in an opposite direction in the longitudinal groove.

7. A device according to claim 1, wherein the die is composed of two half-shells and the means for moving the locking rods for sliding the longitudinal grooves comprises each of the rods at one end being provided with return means urging the rod in a direction toward the other end to cause the oblique surface portions of said ribs to be engaged by the second oblique surfaces, said return means acting between an end wall of the cylinder at the one end and an end stop pressed against a part of the locking rod, and each of the locking rods, at an end opposite the return means, having an extension extending through the other end of said cylinder to extend past an end surface thereof; and a jack mounted on the rotary machine opposite the other end, said jack actuating a semi-circular pushing plate from a retracted position to a pressing position pushing on the extensions of the locking rods to shift the locking rods against the return means to a position to release the oblique surface portions of the rib from the second oblique surfaces associated with the tool carrier cylinder to enable removal of said shell.

8. A device according to claim 1, wherein the die is constructed as two semi-cylindrical shells and the means causing the locking rods to move to a position to engage the ribs comprises return means situated at one end of each one of said longitudinal grooves, said return means acting between an end wall at said one end of the cylinder and an end stop pressed against a part of the locking rod, each of the locking rods, at the other end, having an extension extending out of said other end of the cylinder; and two semi-annular jacks being situated at the other end of said cylinder, each semi-circular jack pushing on a semi-circular rim contacting the extensions of said rods so that actuation of said jack pushes all the rods contacted by the rim against the return means to a position for releasing the engagement of the ribs by said locking rod.

9. A device according to claim 1, wherein each of the rods and grooves have a cross sectional shape of an inverted T, said die being constructed of a pair of semi-circular shells, said means for moving the locking rods toward a locking position including biasing means disposed at one end of the cylinder acting between said one end and a end stop pressed against the locking rod, each of said locking rods having an extension at the opposite end extending past a second end of the cylinder opposite said first end, means acting on said extension to shift the rod against the biasing means to a retracted position releasing the ribs of the shell associated with said rod.

10. A device according to claim 9, wherein the means acting against said extension comprises a jack mounted on said rotary machine adjacent said second end of the cylinder, said jack having a semi-circular push plate for engaging the extensions of the rods in a semi-circular half of said cylinder so that with the alignment of the cylinder with said push plate all the rods holding one shell can be shifted to a retracted position to release said shell and enable its replacement by another shell.

11. A device according to claim 9, wherein said means for acting against the extensions includes a pair of semi-circular pushing rims and a pair of semi-circular jacks acting on said rims, said semi-circular jacks and rims being arranged so that all the locking rods associated with one shell will be shifted to the release position simultaneously by actuation of the jack and will be shifted simultaneously to a locking position when the pressure in said jack is released.

* * * * *